US006520796B1

(12) United States Patent
Reichle

(10) Patent No.: US 6,520,796 B1
(45) Date of Patent: Feb. 18, 2003

(54) CODABLE KINK PROTECTION AND CODING MEANS

(75) Inventor: Hans Reichle, Wetzikon (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 09/784,176

(22) Filed: Feb. 16, 2001

(30) Foreign Application Priority Data

Feb. 21, 2000 (CH) ..... 0326/00

(51) Int. Cl.[7] ..... H01R 3/00
(52) U.S. Cl. ..... 439/491
(58) Field of Search ..... 439/491, 447, 439/676, 488, 344, 352, 901

(56) References Cited

U.S. PATENT DOCUMENTS 3,497,608 A * 2/1970 Elliott et al. ..... 174/135
4,202,351 A 5/1980 Biche ..... 128/696
5,334,044 A 8/1994 Falossi et al.
5,529,513 A 6/1996 Lee ..... 439/491
5,538,438 A 7/1996 Orlando
5,620,335 A 4/1997 Siemon

FOREIGN PATENT DOCUMENTS

EP 0 776 069 A1 5/1997
GB 2304238 12/1997

* cited by examiner

*Primary Examiner*—P. Austin Bradley
*Assistant Examiner*—Phuongchi Nguyen
(74) *Attorney, Agent, or Firm*—Nath & Associates PLLC; Gary M. Nath; Marvin C. Berkowitz

(57) ABSTRACT

A codable kink protection is formed such that this forms an interference-fit connection with a coding sleeve. The coding means are provided with a through slot, thus allowing the coding sleeve to be pushed over the cable and the flexible bush. The coding sleeve is made of an elastic colored plastic and is shaped essentially complementary to the kink protection housing, in order to achieve a form-fit connection therewith. This coding sleeve can be applied and removed without necessitating special tooling and is excellently visible from all viewing angles.

10 Claims, 4 Drawing Sheets

CODABLE KINK PROTECTION AND CODING MEANS

BACKGROUND OF THE INVENTION

The present invention concerns a coding means for a codable kink protection according to the preamble of claim 1, a codable kink protection for an electrical plug, in particular for an RJ jack plug, and a device for an electrical plug, in particular for an RJ jack plug.

Such codable kink protection devices, which firstly have the function of kink protection for cable plug connections and secondly allow marking and identification of corresponding electrical plugs, are used in particular in the area of tele- and data communication. The cabling undertaken in this area is normally performed with universal standard interfaces such as the RJ45 interface so that precautions against the accidental or undesirable connection of incorrect or system-incompatible devices are of great importance in order to prevent equipment damage for example. The need for such cable plug connections to be protected against mechanical loading in particular by kink protection devices and simultaneously thanks to coding prevent the undesirable connection of incorrect and possibly system-damaging equipment, is particularly clear due to the enormous growth rate and increased complexity of the cabling undertaken in this area, which has led to the development of a multiplicity of codable kink protections.

DESCRIPTION OF THE PRIOR ART

EP-776 069 describes a multipin electrical plug which comprises a plug housing divided into a plug housing terminal and an interchangeable plug housing sleeve where the plug housing sleeve can be fixed releasably in a position lying against the plug housing terminal. For coding purposes the interchangeable plug housing sleeve is advantageously formed colored or marked with a code for example coding combs.

In the device described in EP-776 069, the interchangeable plug housing sleeve is fixed in a position lying against the plug housing terminal which makes replacement of the plug housing sleeve and hence the coding for existing cabling impossible without interrupting operation. To change the plug housing sleeve, the electrical plug must first be extracted from the corresponding socket or terminal which, in particular for complex tele- and data communication systems where normally a multiplicity of cabling is arranged very close together, means significant and additional installation expense. In addition such operations can cause damage in particular to cable plug connections next to the plug housing sleeve to be replaced.

U.S. Pat. No. 5,538,438 describes kink protection devices of plastic for cable plugs which can be made in any color and thus used for connection marking. The one-piece kink protection devices, comprising a hinge point and a plug housing, together consist of two half-shells connected together and which can be closed and opened.

U.S. Pat. No. 5,538,438 in comparison with EP-776 069 has the advantage that recoding i.e. changing or replacing the coding or coding means, is possible in an existing installation or cabling, i.e. when the electrical plug is arranged in the corresponding socket or connection terminal. However recoding cannot be carried out simply even with the kink protection devices described in U.S. Pat. No. 5,538,438 as several tabs must be unlocked in order to replace the kink protection device. In addition recoding leads to the electrical plug connection temporarily having no kink protection which can lead to damage in the case of recoding requiring several operations, in particular for complex tele- and data communications systems with a multiplicity of cabling arranged very close together.

U.S. Pat. No. 5,334,044 describes a further codable kink protection which is suitable in particular for an RJ jack plug and which has a long flexible body with a moulded protective cover to hold at least partly the jack of the RJ jack plug, and which kink protection has in its centre area a section of reduced circumference on which is attached, or fitted to form a crimp connection, a C-shaped ring. The C-shaped ring is used to identify the RJ jack plug, to which end the C-shaped ring is color-coded or on its surface has identification marks. The C-shaped ring is in particular made from compound casting so that the identification mark is usually made by embossing the ring surface. The specification indicates that other metals are also suitable for production of the C-shaped ring, however on condition that embossing of the metal surface can be performed.

Practice now shows that even with this codable kink protection device the coding means cannot easily be replaced. In particular practice shows that the C-shaped ring cannot be removed manually and to replace the C-shaped ring normally special tools are required. It has also been found that removing the ring leads to its damage, which makes re-use as a coding means impossible. In addition practice shows that arranging the metal rigid ring in the centre area of the kink protection reduces the kink protective effect and under mechanical influence on the cable plug connection, the stress provoked is not diverted fully from the cable plug connection. Furthermore practice shows that a ring as the coding means not only leads to poor maneuverability on any necessary recoding, but is also difficult to see and hence does not satisfactorily fulfill its function as a coding means.

U.S. Pat. No. 5,620,335 discloses a codable kink protection device which has a flat recess in which is arranged an insert for identification. In particular the identification insert is fastened to the recess by snap closures. The kink protection or recess also has a mounting groove or notch in which a fixed tool or object can be introduced to remove the identification insert for possible replacement.

With this codable kink protection device according to the state of the art it has been found that replacing the coding means or recoding is not possible in a simple manner. In particular a further tool is required for this which incurs considerable extra expense and is disadvantageous in particular for frequent recoding. In addition the need for a tool to change the coding means, as explained above, presents a considerable risk of damaging cable plug connections adjacent to the coding means to be replaced. Furthermore it has been found that repeated changing of the identification insert using the tool to remove this considerably reduces or diminishes the connectability of the snap closure. Practice also shows that the identification inserts described are very easy to overlook or misinterpret, in particular when viewed from the side of the cable plug connection or the entire cabling system.

OBJECTS OF THE INVENTION

One object of the present invention is therefore to avoid the disadvantages of the state of the art.

In particular it is an object of the present invention to create a codable kink protection for an electrical plug in which fixed coding means can be replaced in a simple manner without damaging the kink protection or the plug or parts thereof.

It is also an object of the present invention to create a codable kink protection in which fixed coding means can be replaced simply and without damage, without the kink protection as such needing to be removed from the plug cable connection. In particular a codable kink protection for an electrical plug is to be created in which coding means fixed to the kink protection can be replaced simply and without damage, without the plug needing to be removed from the corresponding socket and hence interrupting operation.

Furthermore it is an object of the present invention to create a coding means for the codable kink protection for an electrical plug where the said coding means can be replaced simply without damaging this or the kink protection or the plug or parts thereof.

A further object of the present invention is to create a coding means for a codable kink protection where the said coding means can be replaced simply and without damage without the kink protection as such needing to be removed from the cable plug connection.

Another object of the present invention is to create a coding means for a codable kink protection for an electrical plug, in particular an RJ jack plug, where the said coding means can be replaced simply and without damage without the plug needing to be removed from the corresponding socket and hence interrupting operation.

A further object of the present invention is to create a coding means for a codable kink protection where the said coding means can be replaced simply and without damage and thus re-used repeatedly.

Another object of the present invention is to create a coding means for a codable kink protection which allows simple and rapid recoding and in particular can be replaced without the use of tools.

A further object of the present invention is to create a codable kink protection and a coding means which in particular allow simple and rapid recoding for cabling systems with a multiplicity of cable plug connections and here reduce or minimise the risk of damage to the cable plug connections.

A further object of the present invention is to create a coding means for a codable kink protection where the said coding means are clearly visible and in particular the visibility of the coding means is not dependent on the viewing angle.

SUMMARY OF THE INVENTION

According to the invention there is provided a coding means for a codable kink protection for an electrical plug, in particular an RJ jack plug, where the kink protection has a kink protection housing for at least partial holding of the electrical plug and a flexible bush, and on which kink protection housing can be attached a coding means, wherein to create a manually releasable connection between the coding means and the kink protection housing the coding means is formed as a sleeve which has a through slot to allow it to surround the kink protection housing, where the coding means consists of an elastic and colored plastic and to create a form-fit connection with the kink protection of the coding means is shaped essentially complementary to the kink protection housing.

BRIEF DESCRIPTION OF THE DRAWINGS

For a better understanding of the invention and to show how the same may be carried into effect, reference will now be made, by way of example, to the accompanying drawings, in which.

In the figures the same parts are marked with the same references.

DESCRIPTION OF THE PREFERRED EMBODIMENT

Figure 1A:
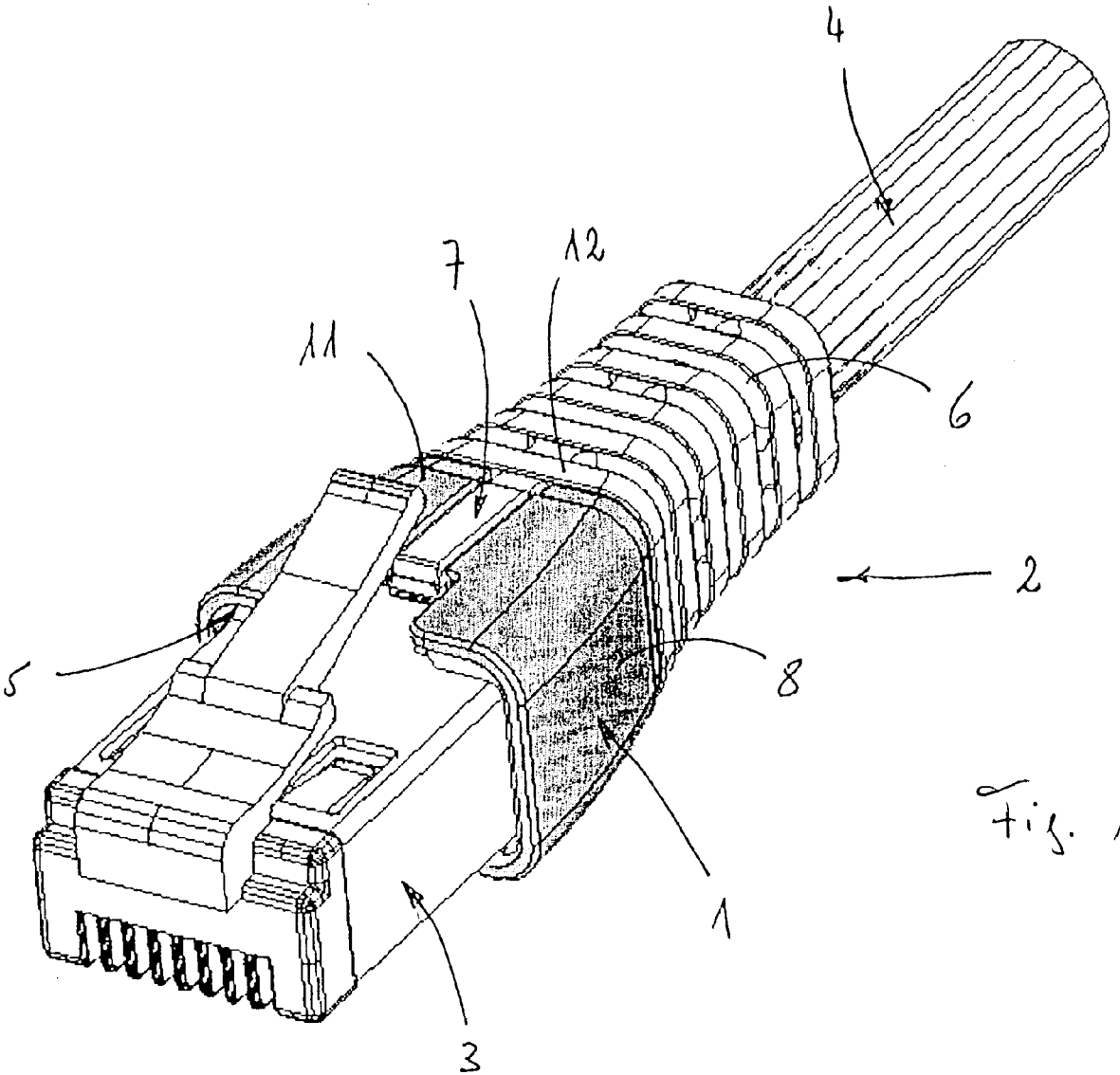
FIG. 1*a* is a diagrammatic perspective view of a preferred embodiment of a device according to the invention in combination with an RJ jack plug.
Figure 1B:
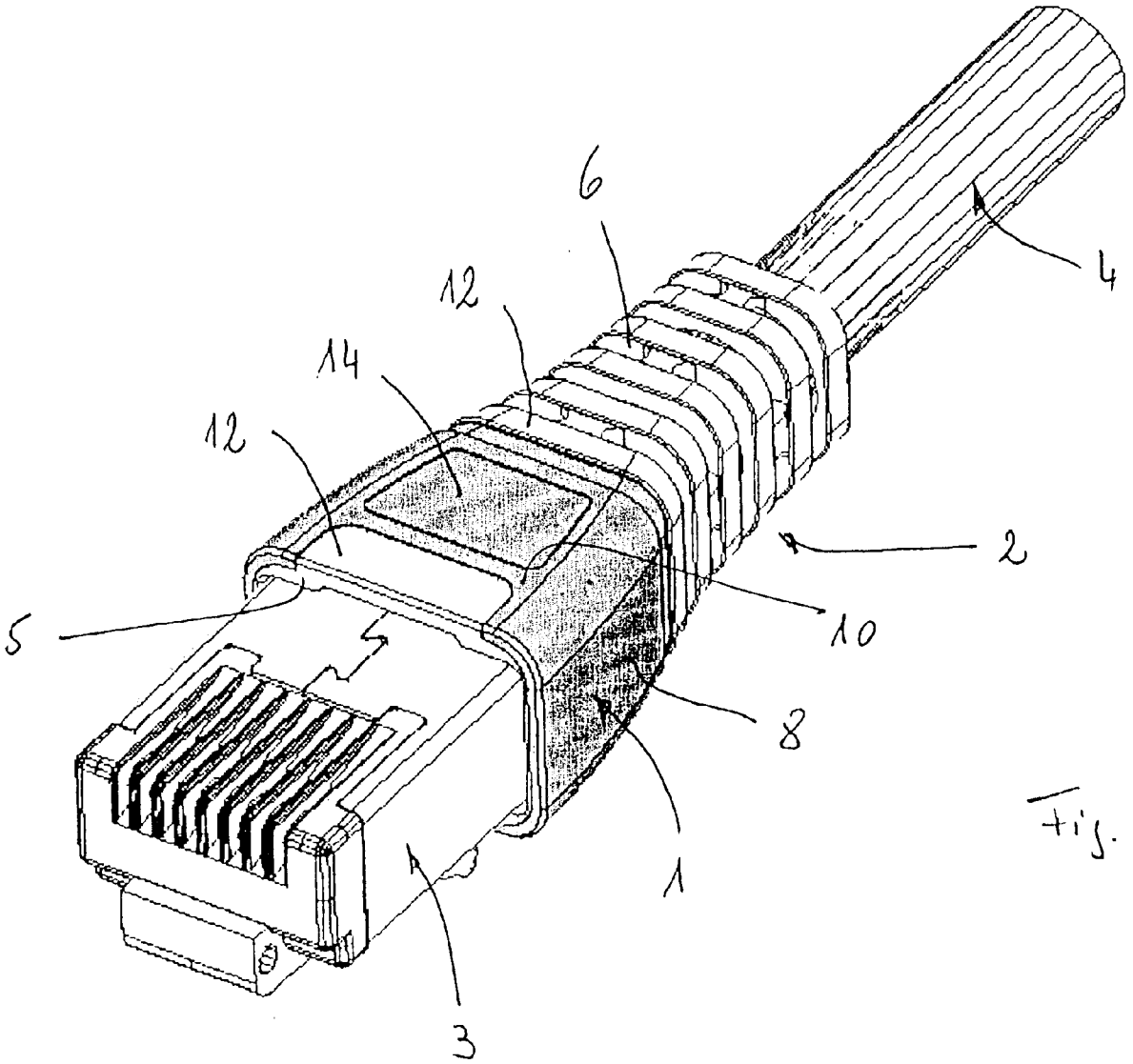
FIG. 1*b* is a top view of the assembly shown diagrammatically in FIG. 1*a*.

FIGS. 1*a* and 1*b* show two different views of a preferred embodiment of the coding means 1 according to invention and a preferred embodiment of the codable kink protection 2 according to the invention. An RJ jack plug 3 is shown which is connected with a multipin cable 4. The kink protection 2 which has a kink protection housing 5 and a flexible bush 6 is arranged so that the RJ jack plug 3 is held at least partly in the kink protection housing 5. In particular the kink protection housing 5 is structured so that a form- and interference-fit connection is made with the RJ jack plug 3. However the RJ jack plug 3 can also be equipped with a metal crimp sleeve or screen sleeve. The codable kink protection 2 advantageously formed as one-piece is easy to push on to the RJ jack plug 3, i.e. the kink protection 2 is arranged in the manner explained by simple pushing.

The coding means 1 arranged on and attached to the kink protection housing 5 advantageously consists of a sleeve which has a through slot 7. This design of coding means 1 allows firstly an extremely simple connection between the coding means 1 and the kink protection housing 5, namely manual without the use of further or special tools, and secondly the kink protection housing 5 can be surrounded by the coding means 1. Such surrounding leads in particular to an interference-fit connection between the coding means 1 and the kink protection housing 5 and in addition prevents the coding means 1 from being removed from the kink protection housing 5 by undesirable external effects such as vibration or similar. Secondly the coding means 1 can very easily be removed, even one-handedly, from the kink protection housing 5 as thanks to the production of the coding means 1 from an elastic plastic, the slot 7 of the coding means or sleeve 1 can be expanded, which removes the surrounding of the kink protection housing 5 by the coding sleeve 1 and the coding sleeve 1 can be removed over the kink protection 2 or cable 4. This proves particularly advantageous as now recoding or release of the coding sleeve 1 from the kink protection housing 5 can be undertaken without the kink protection 2 needing to be removed or the plug 3 being withdrawn from a corresponding socket and hence operation interrupted.

In the case where a conventional RJ jack plug connected to a cable is to be fitted with a codable kink protection and a coding means according to the present invention, the slot advantageously has the width of around 2 mm, preferably at least 3 mm and particularly preferably at least 4 mm.

A further advantage of the design described is that releasing the coding sleeve 1 e.g. for recoding leads to no damage to the coding sleeve 1 or kink protection 2 or plug 3 or parts thereof. In particular the coding means or coding sleeve 1 can be re-used many times. In addition the coding means 1 formed as a colored sleeve guarantees excellent visibility which in particular is independent of the viewing angle.

Advantageously the coding means 1 made of an elastic and colored plastic has a pretension to create an interference-fit connection. The choice of a suitable elastic plastic or the amount of the pretension selected lies in particular within the scope of expert ability. A pretension of the coding means 1 according to invention in particular leads to a further improvement in the interference-fit connection between the kink protection housing 5 and the coding means 1.

The term "elastic" here means that under mechanical stress the plastic undergoes a spontaneous deformation and a spontaneous and reversible reformation, i.e. returning to the original position, occurs after removal of the said mechanical stress.

To create an interference-fit connection of the kink protection 2 with the coding means 1, the kink protection housing 5 and the coding means 1 are essentially shaped complementary. In the preferred embodiment shown in FIGS. 1*a* and 1*b* the kink protection housing 5 and the coding means 1 have a shape which is essentially contained by two rectangular surfaces 8, 9 and two trapezoid surfaces 10, 11.

Here it is evident that for the purpose and essence of the present invention minor deviations from the said geometric shapes can occur. For the present invention therefore essentially rectangular or trapezoid surfaces are present if the connecting edges of the said surfaces are rounded or the edges of the said surfaces in particular the edges running along the cable 4 have slight deviations from linearity and hence the said geometric shape, or if raised areas or recesses such as the slot 7 cause minor deviations from the said geometric shape of the surfaces.

The preferred asymmetrical form of the coding means 1 according to the invention described above leads in particular to the prevention of incorrect application or arrangement and fixing of the coding means or the sleeve 1 on the kink protection housing 5.

In the preferred embodiment of the invention shown in FIGS. 1*a* and 1*b*, the kink protection housing 5 has raised edge areas. This makes removal of the complementary shaped coding means 1 from the kink protection housing 5, which could in particular be due to undesirable or unintentional effects, considerably more difficult or even impossible. Evidently the raised edge areas, in particular when formed at least partly flat as shown in FIG. 1*b*, can serve as advertising areas or for marketing purposes. In addition it is clear that both the coding means 1 and the kink protection housing 5 can have areas 14 which in particular can be used as marking surfaces or similar. These areas are in particular formed flat and for example arranged within the trapezoid surface as shown in FIG. 1*b*. It has proved particularly advantageous here for the coding sleeve 1 to consist of an elastic colored plastic which furthermore is at least partly transparent.

Figure 2:
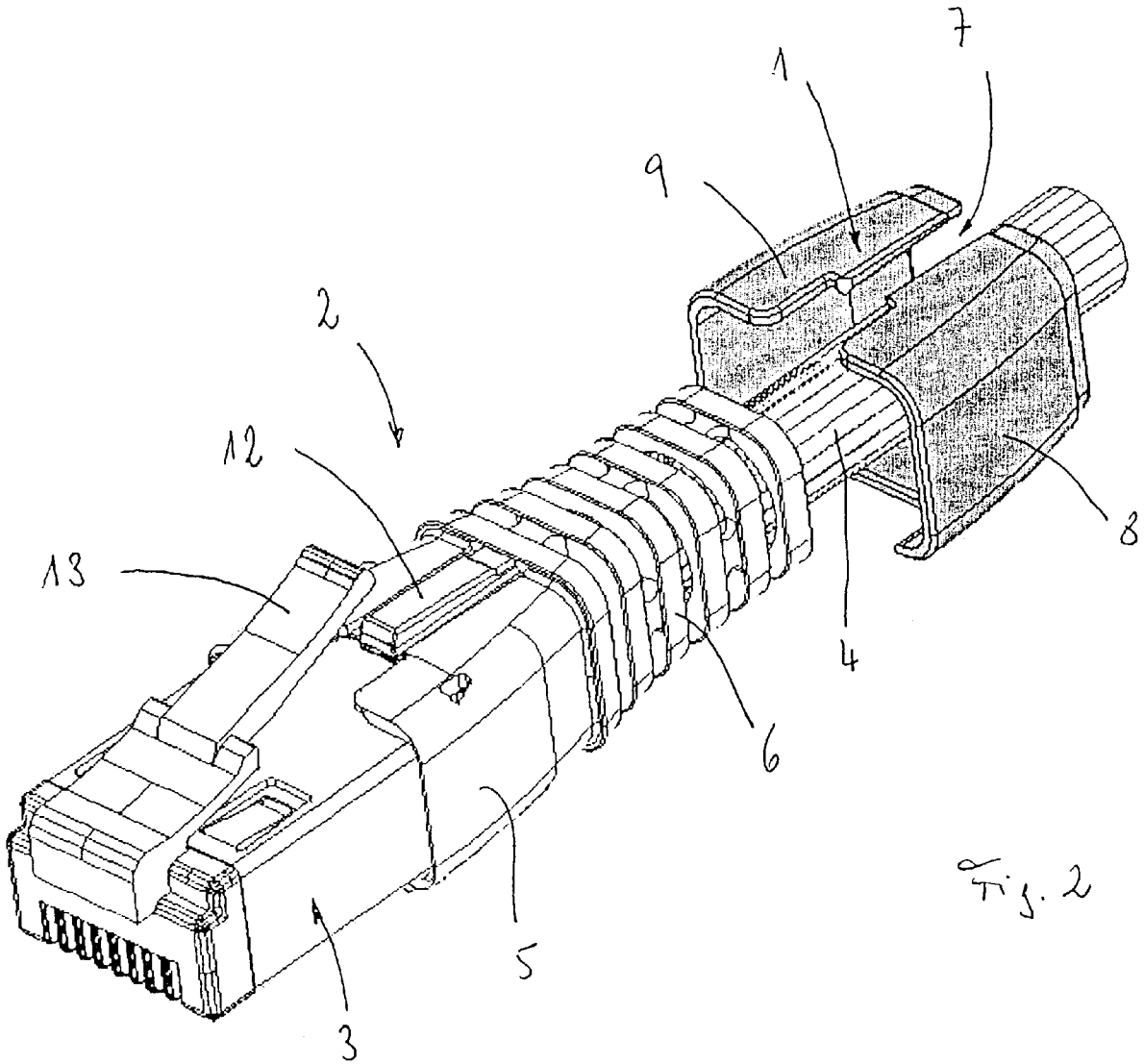
FIG. 2 is a diagrammatic exploded view of the preferred embodiment shown in FIGS. 1*a* and 1*b* of the device according to the invention for an RJ jack plug.
Figure 3:
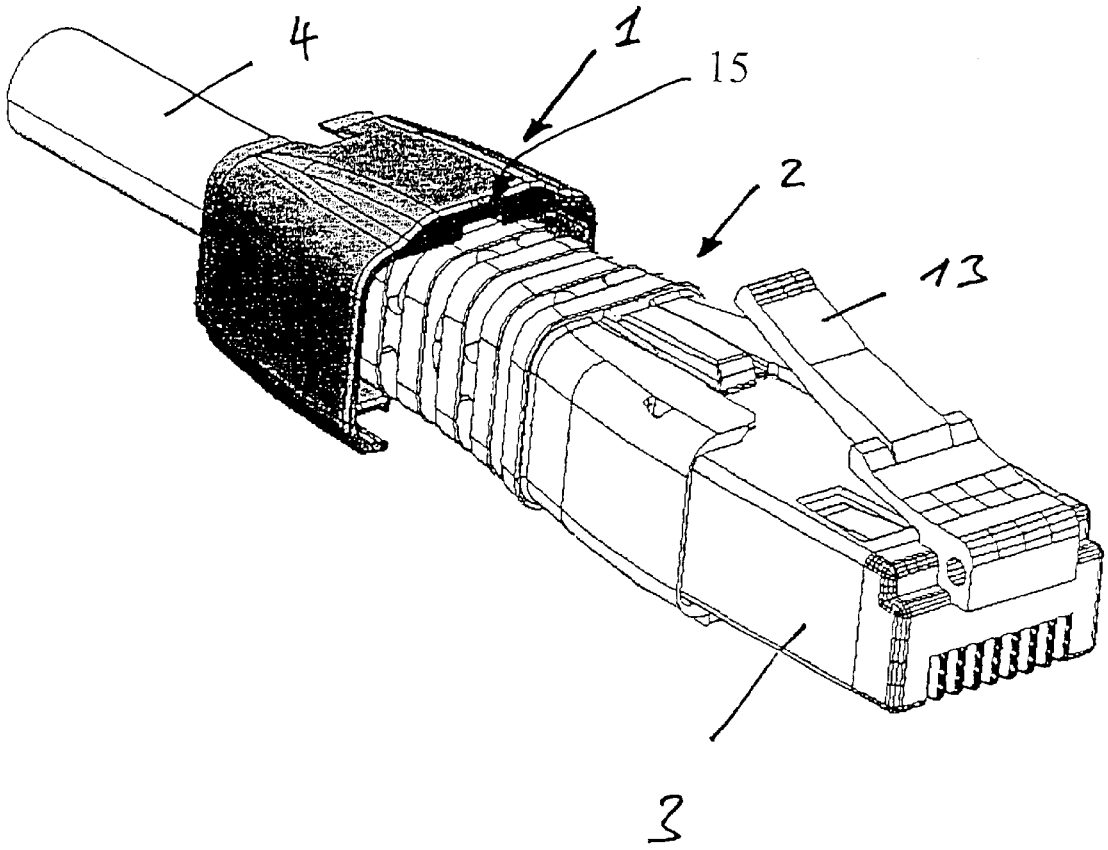
FIG. 3 is a diagrammatic exploded view of an alterative embodiment having a bulge.

FIG. 2 shows the preferred embodiment of the codable kink protection 2 according to the invention and the preferred coding means 1 according to invention in an exploded view. As shown here, to code the kink protection 2 the coding sleeve 1 can be pushed over the cable 4 and the flexible bush 6 into the corresponding position on the kink protection housing 5. Evidently with this embodiment of the invention a side elastic overlapping of the sleeve 1 on the kink protection housing 5 can be made for color coding as explained in detail above.

The preferred kink protection housing 5 of FIG. 2 has in the jack area raised edges 12 without however diminishing the functionality of the release lever 13 of the RJ jack plug 3. The coding sleeve 1 is formed correspondingly complementary. Thus the through slot 7 in the sleeve 1 has two different widths.

Although preferred embodiments of the invention have been described here, it is clear to a person skilled in the at that changes and modifications to the described embodiments can be made without departing from the essence and purpose of the invention. It is evident that coding means 1 or the kink protection housing 5 can have additional means which for example further reinforce the interference-fit connection of the coding means and the kink protection housing. For example the coding means 1 can be shaped so that it engages behind the kink protection housing, for example through bulges 15 formed in the area of the slot. Such bulges 15 have their complementary form according to present invention in the form of recesses in the kink protection housing 5. In addition it is evident that not only the form of the kink protection housing or coding means described in the preferred embodiments in FIG. 1 and FIG. 2 fulfill the purpose of the present invention, but further forms according to invention are possible and lie within the expert scope. For example the rectangular and trapezoid surfaces shown in the figures can deviate from the described or shown parallelity and for example form an oval-shaped sleeve or coding means.

I claim:

1. Coding means for a codable kink protection for an electrical plug, in particular an RJ jack plug, comprising:

a kink protection having a kink protection housing that at least partially holds an electrical plug and a flexible bush, and on which kink protection housing can be attached a coding means, wherein to create a manually releasable connection between the coding means and the kink protection housing the coding means is formed as a sleeve having a through slot to allow said sleeve to surround the kink protection housing, where said coding means consists of an elastic and colored plastic and to create a form-fit connection with the kink protection of the coding means is shaped essentially complementary to the kink protection housing;

wherein an inner geometry of the coding means corresponds to an outer geometry of said kink protection housing, the outer geometry of said kink protection housing having an outer diameter that increases axially in a direction from said flexible bush towards said electrical plug, and the inner geometry of said coding means has an inner diameter that increases axially in the direction from said flexible bush towards said electrical plug whereby said coding means is adapted to sleeve over at least portions of said kink protection housing and said flexible bush.

2. Coding means according to claim 1, wherein the coding means have a pretension to create an inerference-fit connection

3. Coding means according to claim 1, wherein to prevent undesirable or unauthorized release of the RJ jack plug, the coding means has a release lever blocking means, in particular a bulge formed on the sleeve.

4. Coding means according to claim 3, wherein the release lever blocking means is a sliding element.

5. Codable kink protection for an electrical plug, in particular an RJ jack plug, the kink protection comprising a kink protection housing at least partially holding an electrical plug and a bush, said kink protection housing receives on an outer surface thereof a coding means, wherein a manually releasable and form-fit connection between the coding means and the kink protection is provided by respective geometries of the kink protection housing and the coding means being essentially complementary, an outer diameter of said kink protection housing increasing axially in a direction from said bush towards said electrical plug, and the inner diameter of said coding means increasing axially in the direction from said bush towards said electrical plug.

6. Codable kink protection according to claim 5, wherein to prevent removal of said coding means, the kink protection housing has raised edge areas.

7. Codable kink protection according to claim 6, wherein to prevent incorrect application of a coding means, the kink protection housing is formed asymmetrical.

8. Codable kink protection according to claim 7, wherein said coding means is adapted to sleeve over at least portions of said kink protection housing and said bush.

9. Codable kink protection for an electrical plug, is in particular an RJ jack plug, where the kink protection has a kink protection housing for at least partial holding of the electrical plug and a bush, and on which kink protection housing can be attached a coding means; wherein to create a manually releasable connection between the coding means and the kink protection housing the coding means is formed as a sleeve which has a through slot to allow it to surround the kink protection housing, where said coding means consists of an elastic and colored plastic and to create a form-fit connection with the kink protection of the coding means is shaped essentially complementary to the kink protection housing; and wherein to create a.manually releasable and form-fit connection between the coding means and the kink protection, the kink protection housing is formed essentially complementary to the coding means;

wherein an inner geometry of the coding means corresponds to an outer geometry of said kink protection housing, the outer geometry of said kink protection housing having an outer diameter that increases axially in a direction from said flexible bush towards said electrical plug, and the inner geometry of said coding means has an inner diameter that increases axially in the direction from said flexible bush towards said electrical plug whereby said coding means is adapted to sleeve over at least portions of said kink protection housing and said flexible bush.

10. Device for an electrical plug, in particular an RJ jack plug, with a codable kink protection and a coding means, where the kink protection has a kink protection housing for at least partial holding of the electrical plug and a bush, and on which kink protection housing can be attached the coding means;

wherein to create a manually releasable connection between the coding means and the kink protection housing the coding means is formed as a sleeve which has a through slot to allow it to surround the kink protection housing, where said coding means consists of an elastic and colored plastic and to create a form-fit connection with the kink protection of the coding means is shaped essentially complementary to the kink protection housing; and wherein to create a manually releasable and form-fit connection between the coding means and the kink protection, the kink protection housing is formed essentially complementary to the coding means;

wherein an inner geometry of the coding means corresponds to an outer geometry of said kink protection housing, the outer geometry of said kink protection housing having an outer diameter that increases axially in a direction from said flexible bush towards said electrical plug, and the inner geometry of said coding means has an inner diameter that increases axially in the direction from said flexible bush towards said electrical plug whereby said coding means is adapted to sleeve over at least portions of said kink protection housing and said flexible bush.

* * * * *

UNITED STATES PATENT AND TRADEMARK OFFICE

CERTIFICATE OF CORRECTION

PATENT NO. : 6,520,796 B1
DATED : February 18, 2003
INVENTOR(S) : Reichle

It is certified that error appears in the above-identified patent and that said Letters Patent is hereby corrected as shown below:

Column 6,
Line 60, change “have” to -- has --.

Column 7,
Line 17, change “6” to -- 5 --.
Line 23, delete “is”.

Signed and Sealed this

Seventeenth Day of June, 2003

JAMES E. ROGAN
*Director of the United States Patent and Trademark Office*